United States Patent [19]

Murayama et al.

[11] Patent Number: 4,743,181

[45] Date of Patent: May 10, 1988

[54] SCROLL-TYPE FLUID MACHINE WITH SEAL TO AID LUBRICATION

[75] Inventors: Akira Murayama; Hiroaki Kuno; Naoshi Uchikawa; Takahiro Tamura; Takao Mizuno, all of Shimizu, Japan

[73] Assignee: Hitachi, Ltd., Tokyo, Japan

[21] Appl. No.: 819,260

[22] Filed: Jan. 16, 1986

[30] Foreign Application Priority Data

Jan. 23, 1985 [JP] Japan ..... 60-8982

[51] Int. Cl.[4] ..... F04C 18/04; F04C 29/02

[52] U.S. Cl. ..... 418/55; 418/57; 418/94

[58] Field of Search ..... 418/55, 57, 94; 417/902

[56] References Cited

U.S. PATENT DOCUMENTS

| | | | |
|---|---|---|---|
| 3,884,599 | 5/1975 | Young et al. | 418/55 |
| 4,065,279 | 12/1977 | McCullough | 418/55 |
| 4,357,132 | 11/1982 | Konsokabe | 418/55 |
| 4,431,388 | 2/1984 | Eber et al. | 418/55 |
| 4,441,870 | 4/1984 | Ikegawa et al. | 418/55 |
| 4,522,575 | 6/1985 | Tischer et al. | 418/57 X |
| 4,552,518 | 11/1985 | Utter | 418/55 |
| 4,600,369 | 7/1986 | Blain | 418/55 |
| 4,645,437 | 2/1987 | Sakashita et al. | 418/55 |
| 4,648,814 | 3/1987 | Shiibayashi | 418/55 |

FOREIGN PATENT DOCUMENTS 59-150993 8/1984 Japan ..... 418/55

*Primary Examiner*—Carlton R. Croyle
*Assistant Examiner*—T. Olds
*Attorney, Agent, or Firm*—Antonelli, Terry & Wands

[57] ABSTRACT

A scroll-type fluid machine for an air conditioning machine comprises a hermetically closed vessel which houses therein an orbiting scroll member and a stationary scroll member forming together a compressor portion, an Oldham ring member for preventing the orbiting scroll member from rotating about its own axis, a driving motor having a driving shaft connected to the orbiting scroll member for driving the same, and a frame for supporting the shaft, a low pressure liquid introducing passage for making the interior of the hermetically closed vessel a low pressure chamber, and a high pressure fluid discharge passage. A sealing member is provided at the back of the orbiting scroll member with its surfaces slidably contacting the frame and the orbiting scroll member to form a chamber separated from the low pressure chamber. A fluid which is in mid course of being compressed and has an intermediate pressure between suction pressure and discharge pressure is introduced into the separated chamber to maintain the same at the intermediate pressure, thereby overcoming a thrust force exerted on the orbiting scroll member to press the same against the stationary scroll member and effecting a proper supply of lubricating oil to moving portions of the machine.

15 Claims, 4 Drawing Sheets

SCROLL-TYPE FLUID MACHINE WITH SEAL TO AID LUBRICATION

BACKGROUND OF THE INVENTION

The present invention relates to a scroll type fluid machine, and, more particularly, to a scroll compressor of a hermetic type for use in a fluid machine such as an air conditioning machine, a refrigerating apparatus and the like, which includes a hermetically closed low pressure vessel suitable for managing or controlling a thrust force generated in scroll members of the compressor.

In a scroll compressor which comprises an orbiting scroll member and a stationary scroll member each having a spriral wrap, when a gas in the compressor is compressed, the compressed gas generates a force or thrust force which acts to move both a scroll members apart from each other.

In, for example, U.S. Pat. No. 4,365,941, an arrangement is proposed for overcoming the thrust force and permitting the compressor to continue the compressing operation, wherein a back pressure chamber is provided in the back of the orbiting scroll member. The back pressure chamber is hermetically sealed against other portions of the compressor so as to maintain the space of the back pressure chamber at an intermediate pressure higher than the suction pressure of the compressor but lower than the discharge pressure thereof.

In order to apply such a method to a method to a scroll-type fluid machine in which the space in the hermetically closed vessel is maintained at a low pressure, however, it is necessary to improve the compressor so that it has a mechanically suitable construction therefor.

SUMMARY OF THE INVENTION

It is an object of the present invention to provide a scroll-type fluid machine with a hermetically closed vessel maintained at a low (suction) pressure, which has a simple construction suitable for managing or controlling the thrust force exerted on the orbiting scroll member thereof and for feeding a lubrication oil to bearings of the orbiting scroll member.

In accordance with the present invention a scroll-type fluid machine which includes a hermetically closed vessel for housing therein a compressor portion having a compression chamber defined by an orbiting scroll member and a stationary scroll member each of which has spiral wraps and are assembled together with their spiral wrap portions meshing with each other. The stationary scroll member includes a suction port and a discharge port for a fluid, with an Oldham ring member being provided at the back of an end plate of the orbiting scroll member to permit the same to make orbiting movement without rotation about its own axis a driving shaft is connected to the back of the end plate of the orbiting scroll member through a bearing for the orbiting movement, with a frame having a main bearing for supporting the driving shaft being fixedly connected to the compressor portion a driving motor is connected to the driving shaft, with a low pressure fluid introducing passage being provided through the hermetically closed vessel for maintaining the interior thereof at a low pressure so as to define a low pressure chamber a high pressure fluid discharge passage is provided through the hermetically closed vessel and leads from the discharge port of the stationary scroll member a sealing member is provided at the back of the orbiting scroll member with surfaces thereof slidably contacting the frame and the orbiting scroll member to form a chamber separated from the low pressure chamber in the hermetically closed vessel. The Oldham ring member is disposed in the separated chamber, and a passage for introducing a fluid which is in mid course of being compressed is provided through the end plate of the orbiting scroll member, thereby maintaining the separated chamber at an intermediate fluid pressure between a suction pressure and a discharge pressure of the machine.

DETAILED DESCRIPTION OF PREFERRED EMBODIMENTS

Figure 1:
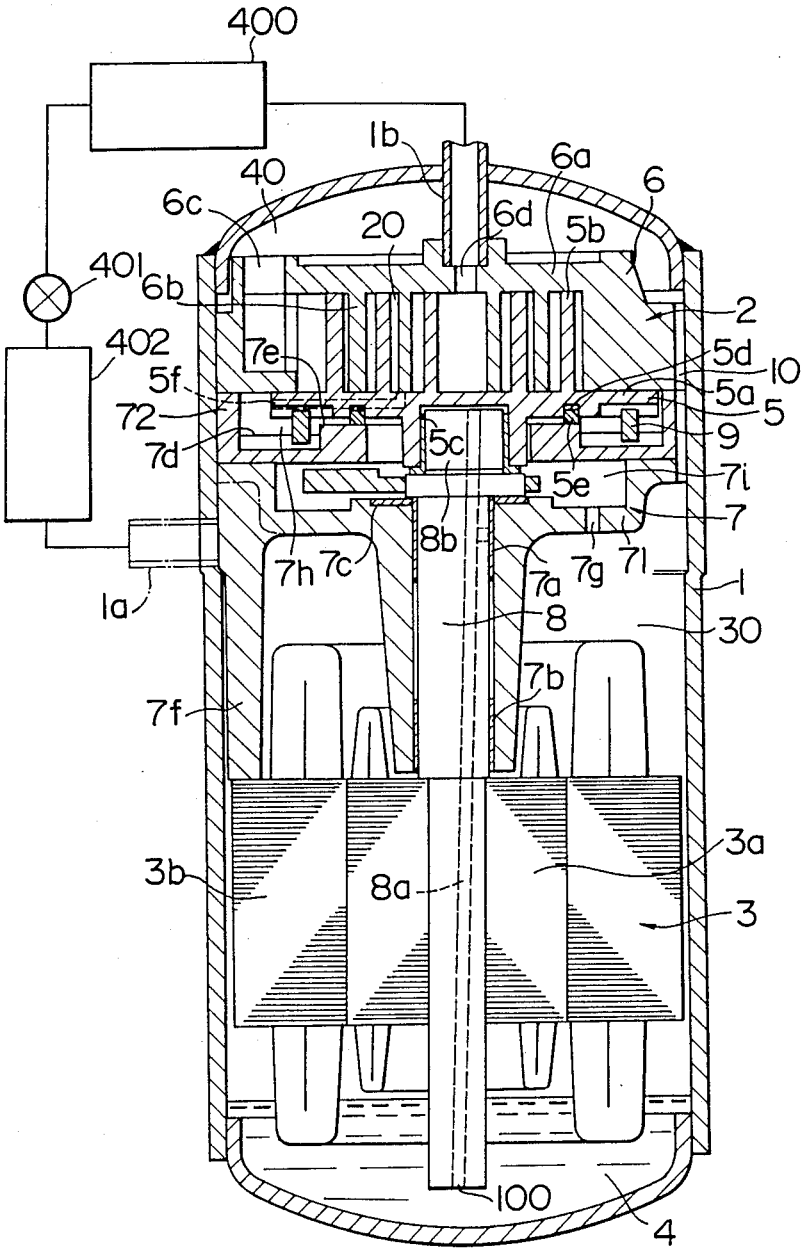
FIG. 1 is a longitudinal sectional view of the scroll-type fluid machine according to an embodiment of the present invention.

Referring now to the drawings wherein like reference numerals are used throughout the various views to designate like parts and, more particularly, to FIG. 1, a compressor portion 2 is housed in a hermetically closed vessel 1 of the vertical type at an upper portion thereof, while a motor 3 is housed in the vessel 1 at a lower position thereof, and the lower bottom portion 4 of the vessel 1 is formed for use as an oil sump.

An orbiting scroll member 5 of the compressor portion 2 has an end plate **5*a* on which a spiral wrap 5*b* is formed to extend from the end plate, and a bearing 5*c* is provided a the back of the end plate 5*a* for receiving a driving crank shaft 8 inserted therein. An Oldham ring member 9 is also provided at the back of the orbiting scroll member 5** to constitute a mechanism for preventing the orbiting scroll member from rotating about its own axis.

The end plate **5*a* is formed in the back thereof with an annular groove 5*d* in which a sealing member 5*e*** is mounted.

The sealing member **5*e* is made of a synthetic resin or a metallic material. The sealing member 5*e* is smaller in diameter than the Oldham ring member 9 and is disposed within the area defined by the inner diameter of the Oldham ring member 9. Thus, the Oldham ring member 9 is disposed in a chamber 7*h*** separated from a low pressure chamber in the hermetically closed vessel 1 by means of the sealing member 5e. Communicating holes 5f are formed through the end plate 5a of the orbiting scroll member 5, each of which holes 5f has an outer end opening in the outer periphery of the end plate 5a and the other end communicating with one space of a compression chamber 20 formed by wraps of the orbiting scroll member 5 and a stationary scroll member 6.

Figure 2:
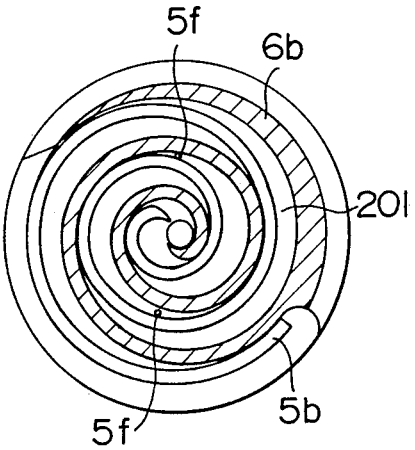
FIGS. 2 and 3 are plan views illustrating a compression chamber in its different position, which is defined by the wraps of the orbiting and stationary scroll members of FIG. 1 meching with each other to show the positional relationship between the compression chamber and communicating holes of the orbiting scroll member.
Figure 3:
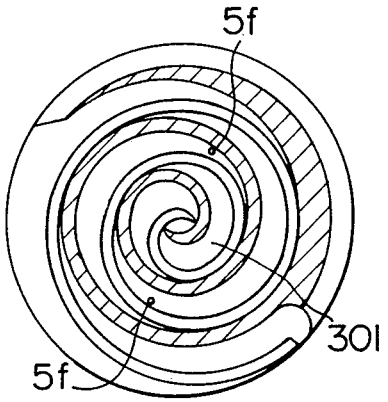

The communicating holes 5f communicate with two spaces of the compression chamber defined in symmetry to each other with respect of the axis of the orbiting scroll member as shown in FIGS. 2 and 3, respectively.

A stationary scroll member 6 has an end plate 6a on which the spiral wrap 6b is formed. A suction hole 6c is formed in the end plate 6a at the outer periphery of the wrap 6b, and a discharge hole 6d is formed in the end plate at the central portion of the wrap 6b. The hole 6d is connected to a discharge pipe 1b which is provided through the hermetically closed vessel 1.

A frame 7 is provided in the vessel to serve also as a partition wall for a motor chamber 30. The frame is constituted by a second frame member 71 provided with bearings 7a, 7b and 7c for support of a crank shaft 8, a portion 7d for receiving the Oldham ring member 9 and a first frame member 72 having a seating surface 7e of the sealing member 5e, and is formed as a separate component from other components.

The second frame member 71 has at its lower end a leg post 7f for supporting the motor 3 to which a motor stator 3b of the motor is secured by, for example, bolts.

The crank shaft 8 is provided with an oil feeding hole 8a which opens at its one end in the central portion of the lower end of the shaft, extends upwardly through the shaft eccentrically with respect to the axis thereof and opens at the other end in the upper end of the crank shaft to serve as an oil feeding pump 100.

The orbiting scroll member 5 and the stationary scroll member 6 are assembled together with their wraps thereof faced inwardly to each other. The stationary scroll member 6 is secured to the second frame member 71 through the first frame member 72 so as to hold the orbiting scroll member 5 between the stationary scroll member 6 and the frame. The chamber 7h of an intermediate pressure is defined on the outer side of the back of the end plate 5a of the orbiting scroll member 5 by the sealing member 5e, the first frame member 72 and the stationary scroll member 6. The crank shaft 8 is supported by the first frame member 71, and an eccentric crank pin portion 8b thereof is inserted in the bearing 5c of the orbiting scroll member. Rotor 3a of the motor 3 is fixedly secured to the lower portion of the crank shaft 8.

A suction pipe 1a is connected to the hermetically closed vessel 1 and is fixedly secured thereto.

A gas passage 10 is formed through the stationary scroll member 6, the first frame member 72 and the second frame member 71. The gas passage 10 may be made in the form of a recess formed between these members and the inner wall of the hermetically closed vessel 1.

A communicating hole perforates the second frame member 71 and serves as a partition wall to establish a communication between a space 7i around the bearing for orbiting movement and the motor chamber 30. A space 40 is defined on the upper side of the stationary scroll member 6 in the hermetically closed vessel 1, with the space 40 communicating with the motor chamber 30 through the gas passage 10.

The reference numeral 400 designates a a condenser 400, in which the refrigerant gas fed under pressure from the discharge pipe 1b, is cooled by means of the medium of air or water to condense into liquid of a high pessure. An expansion valve 401 expands the thus condensed refrigerant to depressurize the same. The reference numeral 402 designates an evaporator wherein the refrigerant evaporates to absorb heat from air or water.

Figure 4:
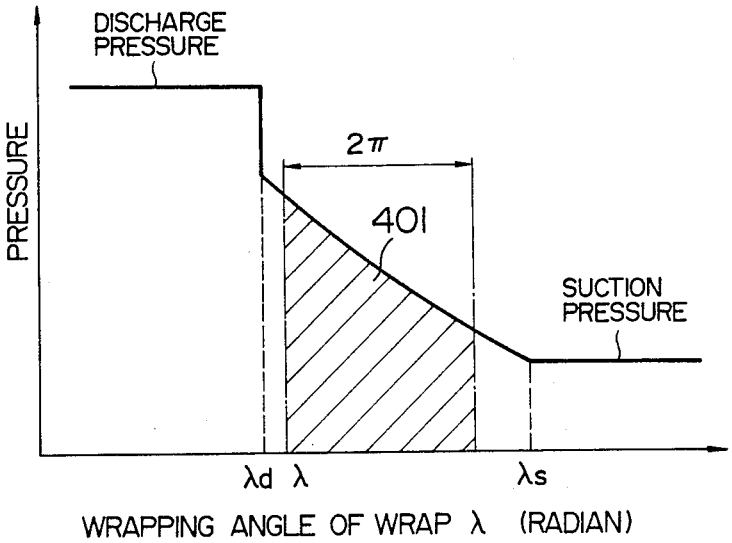
FIGS. 4 and 5 are graphical illustrations of the relationships between the wrap angle of the wrap and the pressure in the compression chamber and between the wrap angle of the wrap and the position of the communicating holes in the scroll type fluid machine according to the invention.

FIG. 2 shows the relative positions of the wraps of the orbiting and stationary scroll members 5 and 6 for defining a space 201 of the maximum volume. FIG. 3 shows the relative positions of the wraps of the scroll members 5 and 6 for defining a space 301 of the minimum volume. FIG. 4 shows variations in the pressure of one space which take place as the volume of the space is being reduced from the maximum volume shown in FIG. 2 to the minimum volume shown in FIG. 3, and the state of communication of the communicating hole 5f with the space during the period when the volume of the space is being reduced.

In FIG. 4, the wrap angle of the wrap 5b of the orbiting scroll member 5 is represented by $\lambda$, the wrap angle of the wrap 5b at the position where the wrap forms the space 201 of the maximum volume is represented by $\lambda s$, and that at the position where the wrap forms the space 301 of the minimum volume is represented by $\lambda d$. Then, the pressure in the intermediate pressure chamber 7H varies due to the communication of the communicating hole 5f with the space from a pressure corresponding to the wrap angle $\lambda$ of the wrap 5b to a pressure corresponding to the wrap angle $\lambda+2\pi$ as shown in FIG. 4, and the average pressure during one orbiting movement of the wrap 5b amounts to the means pressure corresponding to the area of a hatched portion 401.

Figure 5:
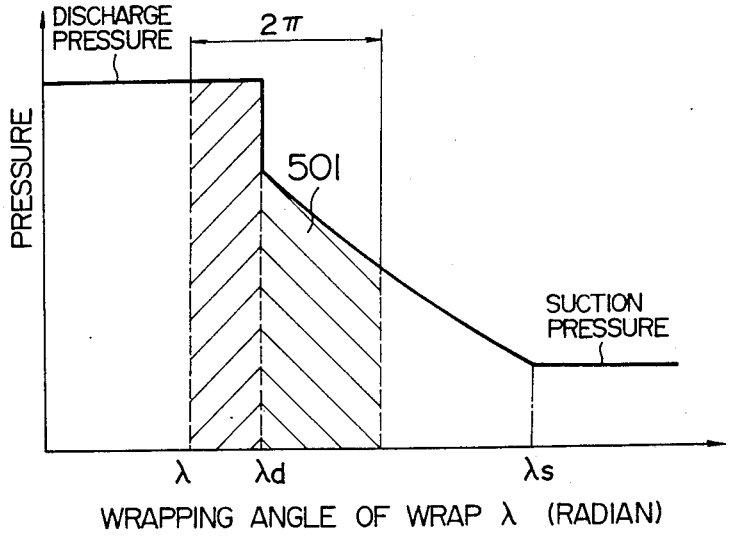

FIG. 5 is a diagram similar to FIG. 4 but shows a different relationship from that shown in FIG. 4, wherein the positions of the communicating holes 5f are changed to those near to the discharge port that they keep communicating with the discharge pressure side of the machine for a certain time period even after the space of the minimum volume commences to communicate with the discharge side. In this case, the average pressure corresponding to the area of a hatched portion 501 becomes higher, thereby permitting the pressure in the intermediate pressure chamber 7h to be further increased.

The operation of the machine described above will be described hereinunder.

When the orbiting scroll member 5 begins an orbiting movement through the rotation of the motor 3, a refrigerant gas of a low temperature and pressure is drawn through the suction pipe 1a into the motor chamber to coll the motor 3. Then, the gas flows upwardly through the passage 10 into the space 40, and is drawn into the suction hole 6c of the stationary scroll member 6. Thus, the gas is compressed in the compression chamber 20 formed by the wraps 5b and 6b of the orbiting and stationary scroll members 5 and 6, and is discharged as a high temperature and high pressure gas through the discharge hole 6d and out of the discharge pipe 1b. The discharged high temperature and pressure gas is fed to a high pressure machine such as the condenser 400. The refrigerant liquefied by the condenser 400 is expanded and depressurized in the expansion valve 401. The thus expanded and depressurized refrigerant flows into the evaporator 402 and absorbs heat from the air or the water to be converted into heated vapor. Then, it flows back into the hermetically closed vessel 1 through the suction pipe 1*a* to complete a refrigeration cycle.

Since the intermediate pressure chamber 7*h* communicates through the communicating holes 5*f* with the spaces of the compression chamber 20 in mid course of compression, the pressure in the intermediate pressure chamber 7*h* comes to an average intermediate pressure which is higher than the suction pressure but is lower than the discharge pressure. The intermediate pressure in the chamber 7*h* acts on the back of the end plate 5*a* of the orbiting scroll member 5 to overcome the thrust force caused by the compressed gas and tending to move the orbiting scroll member 5 apart from the stationary scroll member 6, and urges the orbiting scroll 5 against the stationary scroll member 6 with an appropriate force.

A space 7*i* around the bearing of the orbiting movement is maintained at the same pressure as that in the motor chamber 30 through the communicating hole 7*g*. Accordingly, the suction pressure of the low pressure acts on the back of the end plate 5*a* of the orbiting scroll member 5 on the inner side of the sealing member 5*e*.

Thus, when the oil in the sump at the bottom portion 4 of the hermetically closed vessel 1 is fed through the oil feeding hole 8*a* to the bearing 5*c* of the orbiting scroll member 5 and the bearings 7*a*, 7*b* and 7*c* in the frame 7 by the action of a centrifugal pump effect of the oil feeding hole 8, the supply of the oil is properly performed because the upper end of the oil feeding hole 8*a* communicates with the motor chamber 30 maintained at the low pressure.

Considering the dimensional relationship between the Oldham ring member 9 and the sealing member 5*e*, the sizes thereof effect in the reverse manner to each other.

More specifically, a better performance is obtained as the diameter of the Oldham ring member 9 is made larger, and as the diameter of the sealing member 5*e* is made smaller. As a result of the orbiting movement of the orbiting scroll member 5, a rotatry moment is generated in the member 5. This rotatry moment is entirely carried by the contacting surfaces of a slide key in the Oldham ring member 9 and the wall of a cut-out groove in the Oldham ring. The amount of the rotatory moment to be born by the Oldham ring member 9 is the product obtained by multiplying the radius of the Oldham ring member 9 by the force received by this radius. This means that the force to be received by the Oldham ring member 9 can be made smaller as the radius or diameter thereof is made larger. As the force to be carried by the Oldham ring is made smaller, the surface pressure exerted on the wall thereof becomes smaller, thereby permitting the wear of the Oldham ring member 9 to be reduced. In addition, the stability of supporting the orbiting scroll member 5 by the Oldham ring member 9 is enhanced as the diameter of the latter is made larger.

A smaller diameter of the sealing member 5*e* is more effective for preventing the leakage of the gas since a smaller diameter of the member 5*e* results in the reduction of the sealing area thereof. Further, by reducing the diameter of the sealing member 5*e*, the relative sliding velocity between the sealing surfaces of the sealing member 5*e* and the other member contacting with each other is lower thereby reducing the wear thereof.

Figure 6:
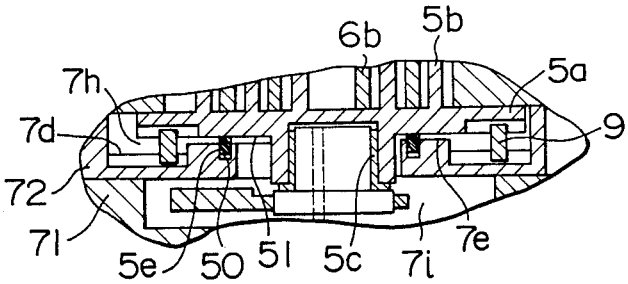
FIG. 6 is a fragmentary sectional view showing a modification of the scroll-type fluid machine of FIG. 1 wherein a sealing member is formed in a ring-shape.

According to the present invention, the construction of the sealing portion of the machine can be modified such that, as shown in FIG. 6, an annular groove 50 for receiving the sealing member 5*e* is formed in the receiving portion 7*e* of the first frame member 72, while a back surface 51 of the end plate 5*a* of the orbiting scroll member 5 is adapted to serve as a sealing surface.

With the sealing construction described above, since no groove is formed in the end plate 5*a* of the orbiting scroll member 5, the rigidity thereof can be improved while the assembly is made easy.

Figure 7:
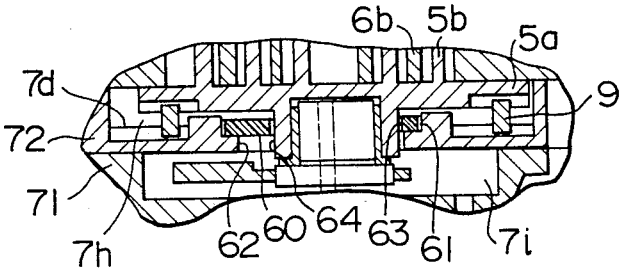
FIG. 7 is a fragmentary sectional view showing another modification of the scroll-type fluid machine of FIG. 1 in which the sealing member is formed in a plate-like shape.

Further, it is possible to modify the sealing portion of the machine such that, as shown in FIG. 7, a cut-out groove 61 for receiving a sealing member 60 is formed in the inner peripheral portion 62 of the first frame member 72, and that the sealing member 60 is made in the form of a disc having an eccentric hole 63. The sealing member 60 is mounted on the first frame member 72 with the eccentric hole 63 letting the outer diameter portion 64 of a bearing boss provided on the orbiting scroll member 5 pass therethrough and with the outer peripheral portion of the member 60 inserted into the groove 61 in the innner peripheral portion 62 of the first frame member 72.

With the above described construction, the intermediate pressure chamber 7*h* is provided to extend over the entire area of the back of the end plate 5*a* of the orbiting scroll member 5. Therefore, the reaction force against the thrust force can be made greater. Further, since no seating surface for the sealing member is formed in the orbiting portion of the orbiting scroll member 5, the centrifugal force of the orbiting scroll member acting on the crank shaft 8 can be reduced.

Figure 8:
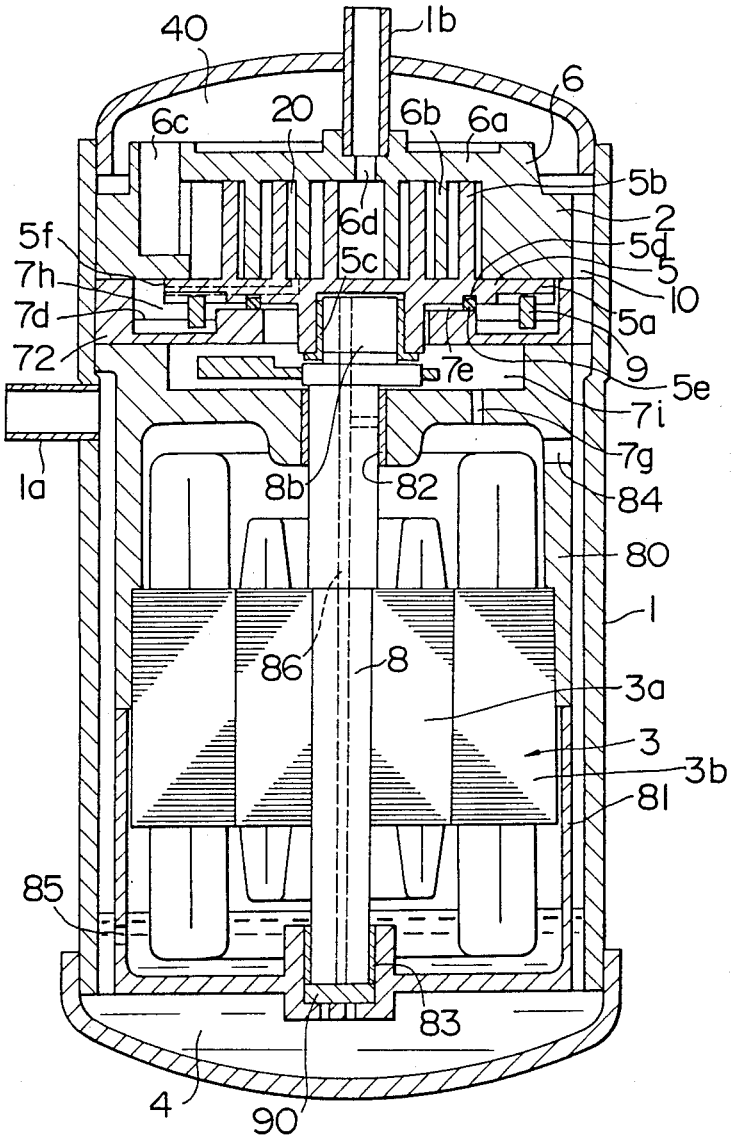
FIG. 8 is a longitudinal sectional view of the scroll-type fluid machine according to another embodiment of the present invention.

The present invention can be embodied as shown by the alternative embodiment in FIG. 8, wherein a second frame member 80 is formed to support the motor stator 3*b* and a bearing 82 for supporting the crank shaft 8, and a side cover 81 is provided to support a bearing 83 for the crank shaft 8 and an oil feeding pump 90 serving also as a thrust bearing. According to this arrangement, it is possible to effect a further stabilized supply of oil to the moving portions of the machine.

As shown in FIG. 8, a gas pressure equalizing passage 84, an oil passage 85, and an oil feeding hole 86 are provided.

In the embodiment of FIG. 8, the outer portion of the back of the end plate of the orbiting scroll member is subjected to the intermediate pressure, while the inner portion thereof around the bearing for orbital movement is exposed to the same low pressure as that in the hermetically closed vesses. Therefore, feeding of oil can be performed by the oil pressure of a small head.

Further, since the orbiting scroll member can be closely pressed against the stationary scroll member with an appropriate force, the gap between the tips of the wraps can be kept small, thereby permitting the machine to have a high performance and reducing the loss in power of the machine owing to the sliding movement of the end plate of the orbiting scroll member and the wear thereof.

By virtue of the above described construction of the invention wherein the interior of the hermetically closed vessel is maintained at a low pressure, the effective management or control of a thrust force in the orbiting scroll member and the stable feeding of a lubricating oil can be achieved with the simple structure.

What is claimed is:

1. A scroll compressor for an air conditioning machine, the scroll compressor comprising:

a compressor portion having a compression chamber defined by an orbiting scroll member and a stationary scroll member housed in an upper portion of a vertical type hermetically closed cylindrical vessel, said orbiting and stationary scroll members each having a spiral wrap and being assembled together with said spiral wraps meshing with each other;

a motor disposed in a lower portion of said hermetically closed vessel and connected to said compressor portion through a driving shaft;

an oil sump portion formed at a bottom portion of said hermetically closed vesesl below said motor;

oil feeding pump means provided in said driving shaft and having a suction port immersed in said oil sump;

said hermetically closed vessel communicating with a low pressure side of a refrigerating cycle to form a low pressure chamber in said hermetically closed vessel, said compressor portion drawing a refrigerant gas into said low pressure chamber of said hermetically closed vessel, compressing the same and discharging the compressed gas out of said hermetically closed vessel;

a first frame facing a lower surface of said orbiting scroll member;

a sealing member disposed radially outwardly of a bearing means for coupling the driving shaft of the scroll compressor and a bearing means for supporting the driving shaft so that the bearing means are exposed to a lower pressure, said sealing member being disposed between said first frame and the lower surface of said orbiting scroll member with surfaces thereof being in slidable contact with said frame and the lower surface of said orbiting scroll member;

a chamber provided in said hermetically closed vessel separate from said low pressure chamber by said sealing member and accommodating therein a member for preventing rotation of said orbiting scroll member about its own axis;

a second frame having at least one bearing for supporting said driving shaft between said first frame and said motor and supporting a stator of said motor secured to said second frame; and a passage means provided through an end plate of said orbiting scroll member for introducing the refrigerant gas whcih is in mid course of being compressed in said compression chamber into said separated chamber from said low pressure chamber to maintain said separated chamber at an intermediate pressure between a suction pressure and a discharge pressure of said scroll compressor.

2. A scroll compressor according to claim 1, wherein said sealing member includes a ring having a rectangular cross-sectional shape in, and is fitted in an annular groove formed in either one of said end plate of said orbiting scroll member and said first frame.

3. A scroll compressor according to claim 2, wherein said ring is made of either one of a synthetic resin and a metallic material.

4. A scroll compressor according to claim 1, wherein said sealing member is in the form of a plate having an eccentric through-hole, said eccentric through-hole being formed to permit a boss provided on said orbiting scroll member for receiving a bearing to pass therethrough and, wherein said sealing member is secured with an outer peripheral portion of said plate being inserted into a cut-out groove formed in said first frame.

5. A scroll compressor according to claim 1, wherein said hermetically closed vessel defines a space above said stationary scroll member of said compressor portion, and said space and a chamber in said vessel for housing said motor are communicated with each other through a passage.

6. A scroll compressor for an air conditioning machine, the scroll compressor comprising:

a compressor portion having a compression chamber defined by an orbiting scroll member and a stationary scroll member housed in an upper portion of a vertical type hermetically closed cylindrical vessel, said orbiting and stationary scroll members each having a spiral wrap and being assembled together with said spiral wraps meshing with each other;

a motor disposed in a lower portion of said hermetically closed vessel and connected to said compressor portion through a driving shaft;

an oil sump portion formed at a bottom portion of said hermetically closed vessel below said motor;

oil feeding pump means provided in said driving shaft and having a suction port immersed in said oil sump;

said hermetically closed vessel communicating with a low pressure side of a refrigerating cycle to form a low pressure chamber pressure side of a refrigerating cycle to form a low pressure chamber in said hermetically closed vessel, said compressor portion drawing a refrigerant gas into said low pressure chamber of said hermetically closed vessel, compressing the same and discharging the compressed gas out of said hermetically closed vessel;

a first frame facing a lower surface of said orbiting scroll member;

a sealing member disposed between said first frame and the lower surface of said orbiting scroll member with surfaces thereof being in slidable contact with said frame and the lower surface of said orbiting scroll member, said sealing member being disposed radially outwardly of a bearing means for coupling the driving shaft of the scroll compressor and a bearing means for supporting the driving shaft so that the bearing means are exposed to a low pressure;

a chamber provided in said hermetically closed vessel separate from said low pressure chamber by said sealing member and housing therein a member for preventing rotation of said orbiting scroll member about its own axis;

a second frame means including said bearing means for supporting said driving shaft between said first frame and said motor and supporting a stator of said motor secured to said second frame;

a motor cover including a second bearing for supporting a lower end of said driving shaft and secured to said second frame;

an oil passage means for communicating a bottom portion of said motor cover with said oil sump portion;

a gas pressure equalizing passage means providing through said second frame member for communicating a motor chamber between said second frame and said motor with said low pressure chamber;

a communicating hole means provided through said second frame for communicating said motor chamber with a space formed behind an end plate of said orbiting scroll member and around a bearing for orbital movement provided in said orbiting scroll member; and a passage means provided through said end plate of said orbiting scroll member for introducing the refrigerant gas which is in mid course of being compressed in said compression chamber into said separated chamber from said low pressure chamber to maintain said separated chamber at an intermediate pressure between a suction pressure and a discharge pressure of said scroll compressor.

7. A scroll compressor according to claim 6, wherein said sealing member a ring having a rectangular cross-sectional shape, and is fitted in an annular groove formed in either of said end plate of said orbiting scroll member and said first frame.

8. A scroll compressor according to claim 7, wherein said ring is made of either one of a synthetic resin and a metallic material.

9. A scroll compressor according to claim 6, wherein said sealing member is in the form of a plate having an eccentric hole, said eccentric hole being formed to permit a boss provided on said orbiting scroll member for receiving a said bearing for orbital movement to pass therethrough and wherein said sealing member is secured with an outer peripheral portion of said plate inserted into a cut-out groove formed in said first frame.

10. A scroll compressor according to claim 6, wherein said hermetically closed vessel defines a space above said stationary scroll member of said compressor portion, and wherein passage means are provided for communicating said space above said stationary scroll member and said motor chamber.

11. A scroll-type fluid machine including:

a hermetically closed vessel means for housing therein a compressor portion having a compression chamber defined by an orbiting scroll member and a stationary scroll member each having a spiral wrap, said stationary scroll member having a suction port and a discharge port for a fluid, said stationary scroll member and said orbiting scroll member being assembled together with said spiral wraps meshing with each other, a rotation preventing means provided at a back of an end plate of said orbiting scroll member for permitting the same to make orbiting movement without rotation thereof about its own axis, a driving shaft connected to the back of said end plate of said orbiting scroll member through a bearing for the orbiting movement, a frame having at least one main bearing for supporting said driving shaft and fixedly connected to said compressor portion, and a driving motor connected to said driving shaft;

a low pressure fluid introducing passage means provided through said hermetically closed vessel for maintaining an interior thereof at a low pressure to form a low pressure chamber; and a high pressure fluid discharge passage means provided through said hermetically closed vessel and leaving from said discharge port of said stationary scroll member;

a sealing member provided at the back of said orbiting scroll member of said compressor portion with surfaces thereof slidably contacting said frame and said orbiting scroll member to form a chamber separated from said low pressure chamber in said hermetically closed vessel, said sealing member being disposed radially outwardly of the bearing means for coupling the driving shaft of the scroll compressor and the bearing for orbiting movement so that the driving shaft and bearings are exposed to a low pressure;

said rotation preventing means being disposed in said separated chamber; and a passage means for introducing the fluid which is in mid course of being compressed provided through said end plate of said orbiting scroll member, thereby maintaining said separated chamber at an intermediate fluid pressure between a suction pressure and a discharge pressure of said scroll-type fluid machine.

12. A scroll-type fluid machine according to claim 11, wherein said sealing member is in the form of a ring having a rectangular shape in cross-section, and is fitted in an annular groove formed in either one of said end plate of said orbiting scroll member and said first frame.

13. A scroll-type fluid machine according to claim 12, wherein said ring of the rectangular cross-section is made of either one of a synthetic resin and a metallic material.

14. A scroll-type fluid machine according to claim 11, wherein said sealing member is in the form of a plate having an eccentric through-hole, said eccentric through-hole being formed to allow a boss provided on said orbiting scroll member for receiving a bearing to pass therethrough, and wherein said sealing member is secured with an outer peripheral portion of said plate being inserted into a cut-out groove formed in said first frame.

15. A scroll-type fluid machine according to claim 11, wherein said hermetically closed vessel means defines a space above said stationary scroll member of said compressor portion, and said hermetically closed space and a chamber in said vessel means for housing said motor are communicated with each other through a passage.

* * * * *